US008206484B2

(12) United States Patent
Claasen et al.

(10) Patent No.: US 8,206,484 B2
(45) Date of Patent: Jun. 26, 2012

(54) PROCESS FOR PRODUCING MICRON AND SUBMICRON FIBERS AND NONWOVEN WEBS BY MELT BLOWING

(75) Inventors: Gert Claasen, Richterswil (CH); Gerrit J. Brands, Terneuzen (NL); Leonardo C. Lopez, Midland, MI (US); Rene Broos, Bornem (BE); Thomas Allgeuer, Wollerau (CH); Wu Chen, Lake Jackson, TX (US); James F. Sturnfield, Rosharon, TX (US)

(73) Assignee: Dow Global Technologies LLC

( * ) Notice: Subject to any disclaimer, the term of this patent is extended or adjusted under 35 U.S.C. 154(b) by 401 days.

(21) Appl. No.: 12/539,799

(22) Filed: Aug. 12, 2009

(65) Prior Publication Data

US 2010/0037576 A1 Feb. 18, 2010

Related U.S. Application Data

(60) Provisional application No. 61/088,539, filed on Aug. 13, 2008.

(51) Int. Cl.
*B01D 39/16* (2006.01)

(52) U.S. Cl. ..... 55/528; 55/522; 55/527; 210/500.27; 210/510.1; 442/400; 264/165; 264/176.1

(58) Field of Classification Search ..... 264/176.1, 264/211.12–211.24, 164–218, 454–459, 264/464, 472; 55/522–528; 210/483–510.1; 442/327–417; 128/205.27–206.19
See application file for complete search history.

(56) References Cited

U.S. PATENT DOCUMENTS

| | | | | |
|---|---|---|---|---|
| 4,650,506 | A | 3/1987 | Barris et al. | |
| 5,582,907 | A | 12/1996 | Pall | |
| 5,622,537 | A | 4/1997 | Kahlbaugh et al. | |
| 5,645,057 | A * | 7/1997 | Watt et al. | 128/206.12 |
| 6,172,167 | B1 | 1/2001 | Stapert et al. | |
| 6,183,670 | B1 | 2/2001 | Torobin et al. | |
| 6,315,806 | B1 | 11/2001 | Torobin et al. | |
| 6,355,772 | B1 | 3/2002 | Gruber et al. | |
| 6,395,046 | B1 | 5/2002 | Emig et al. | |
| 6,554,881 | B1 | 4/2003 | Healey | |
| 6,613,268 | B2 | 9/2003 | Haynes et al. | |
| 6,746,517 | B2 | 6/2004 | Benson et al. | |
| 6,833,104 | B2 | 12/2004 | Berger | |
| 6,858,057 | B2 | 2/2005 | Healey | |

(Continued)

FOREIGN PATENT DOCUMENTS

EP 1775006 4/2007

(Continued)

OTHER PUBLICATIONS

Ciferi, "Supramolecular Polymers", 2nd Edition, 2005, pp. 157-158.

(Continued)

*Primary Examiner* — Duane Smith
*Assistant Examiner* — Thomas McKenzie

(57) ABSTRACT

This invention is a method for fabricating fibers by melt-blowing a melt of a molecularly self-assembling material, the melt being at a temperature of from 130° C. to 220° C., thereby forming a fiber set having a distribution of fiber diameters wherein at least 95% of the fibers have a diameter of less than about 3 microns. The invention further comprises collecting the fiber set so as to form a fibrous non-woven web.

20 Claims, 6 Drawing Sheets

U.S. PATENT DOCUMENTS

| | | | |
|---|---|---|---|
| 6,875,256 | B2 | 4/2005 | Gillingham et al. |
| 7,008,465 | B2 | 3/2006 | Graham et al. |
| 2002/0073849 | A1 | 6/2002 | Buettner et al. |
| 2004/0116019 | A1 | 6/2004 | Zucker et al. |
| 2005/0037194 | A1 | 2/2005 | Greene et al. |
| 2006/0084341 | A1 | 4/2006 | Bodaghi et al. |
| 2008/0023888 | A1 | 1/2008 | Brang et al. |
| 2010/0038304 | A1 | 2/2010 | Chen et al. |
| 2010/0041296 | A1 | 2/2010 | Lopez et al. |
| 2010/0064647 | A1 | 3/2010 | Brands et al. |

FOREIGN PATENT DOCUMENTS

| | | |
|---|---|---|
| JP | 01298259 | 12/1989 |
| JP | 08113861 | 5/1996 |
| WO | 0108781 | 2/2001 |
| WO | 0112896 | 2/2001 |
| WO | 2005023534 | 3/2005 |
| WO | 2006044141 | 4/2006 |
| WO | 2007030791 | 3/2007 |
| WO | 2007099397 | 9/2007 |
| WO | 2007121458 | 10/2007 |
| WO | 2008055860 | 5/2008 |
| WO | 2008150970 | 12/2008 |

OTHER PUBLICATIONS

Corbin et al., "Chapter 6 Hydrogen-Bonded Supramolecular Polymers: Linear and Network Polymers and Self-Assembling Discotic Polymers", Supramolecular Polymers, 2nd edition, CRC Press, 2005, pp. 153-185.

Grafe et al., "Polymeric Nanofibers and Nanofiber Webs: A New Class of Nonwovens", presented at INTC 2002: International Nonwovens Technical Conference (Joint INDA—TAPPI Conference), Atlanta, Georgia, Sep. 24-26, 2002, 13 pages.

Graham et al., "Polymeric Nanofibers in Air Filtration Applications", Advances in Filtration and Separation Technology, 2002, vol. 15, 500-524.

Hagewood, "Potential of Polymeric Nanofibers for Nonwovens and Medical Applications", Fiberjournal.com, Feb. 26, 2008, 4 Pages, J.Hagewood, LLC and Ben Shuler, Hills, Inc.

Koevoets et al., "Molecular Recognition in a Thermoplastic Elastomer", Journal of the American Chemical Society, 2005, pp. 2999-3003, vol. 127.

Kosmider et al., "Polymeric Nanofibres Exhibit an Enhanced Air Filtration Performance", www.filtsep.com, 2002, Jul./Aug. 20-22.

Lips et al., "Incorporation of different crystallizable amide blocks in segmented poly(ester amide)s", Polymer, 2005, pp. 7834-7842, vol. 46, Elsevier Ltd.

Lips et al., "Synthesis and characterization of poly(ester amide)s containing crystallizable amide segments", Polymer, 2005, pp. 7823-7833, vol. 46, Elsevier Ltd.

Shambaugh, "General Research: A Macroscopic View of the Melt-Blowing Process for Producing Microfibers", Ind. Eng. Chem. Res., 1988, pp. 2363-2372, vol. 27, American Chemical Society.

Suthar et al., "Performance of Meltblown Media With Nanofibers", Advances in Filtration and Separation Technology, 2002, vol. 15, pp. 265-273.

* cited by examiner

PROCESS FOR PRODUCING MICRON AND SUBMICRON FIBERS AND NONWOVEN WEBS BY MELT BLOWING

CROSS-REFERENCE TO RELATED APPLICATION(S)

This application claims benefit of priority from U.S. Provisional Patent Application No. 61/088,539, filed Aug. 13, 2008, which application is incorporated by reference herein in its entirety.

FIELD OF THE INVENTION

This invention relates to the fabrication of melt-blown fibers and non-woven webs where the fibers are made from molecularly self-assembling materials.

BACKGROUND

Producing melt-blown polymeric or oligomeric fibers and non-woven webs with small fiber diameters and narrow distributions of fiber diameters at commercially effective conditions is difficult. Commercial melt-blowing machines have difficulty in producing these fiber sizes at standard throughputs with conventional polymer compositions and generally can only achieve such fiber sizes at decreased throughput rates and/or extreme processing conditions if at all. In order to commercially produce fiber with diameters on the order of from less than one micron to three microns, very high Melt Flow Index (MFI) materials are required and their MFI values can exceed 2000: only a limited number of such materials are known, including for example high MFI polypropylene. Unfortunately, these high MFI materials (low molecular weight) materials inherently suffer from poor physical properties, and thus produce poor fiber and non-woven products. Other factors that can significantly increase melt-blown fiber production costs, to achieve acceptable non-woven web production rates, include: energy for high polymer melt temperatures, (often in the range of from 230° C.-350° C. or greater), high Stretch Air (SA) temperature (often as high as or higher than the melt temperature), and large Stretch Air volumes.

BRIEF SUMMARY OF THE INVENTION

In a first aspect, the invention is a method for fabricating fibers, the method comprising melt-blowing a melt of a molecularly self-assembling material, the melt being at a temperature of from 130° C. to 220° C., thereby forming a fiber set having a distribution of fiber diameters wherein at least about 95% of the fibers have a diameter of less than about 3 microns.

In an additional aspect, the invention provides an article comprising or prepared from the melt-blown fibers comprised of a molecularly self-assembling material wherein at least 95% of the fibers have a diameter of less than about 3 microns.

Additional features and advantages of preferred embodiments of the invention will be described hereinafter. Specific embodiments of the invention are examples of preferred embodiments and not necessarily to be considered limitations of the broadest conception of the invention.

Figure 1:
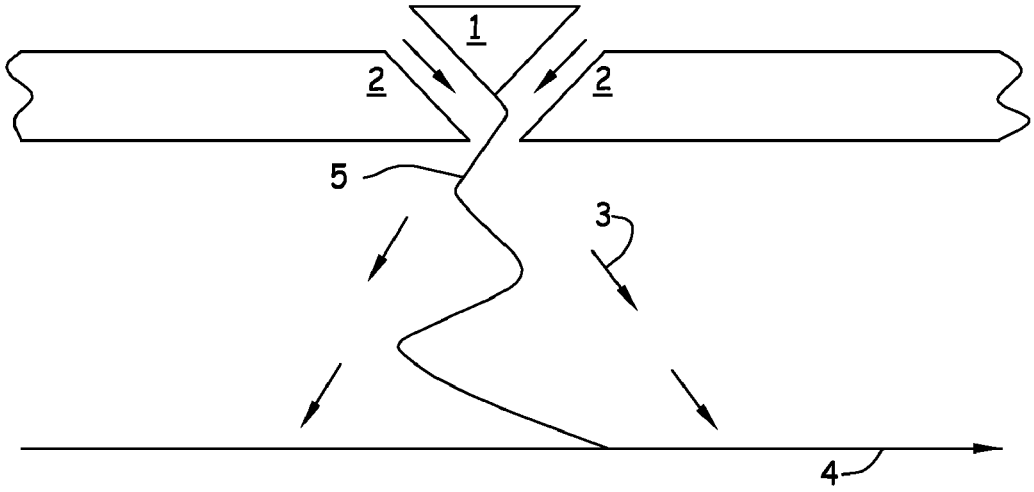
FIG. 1 is a schematic of a basic melt-blowing process system.

It is to be expressly understood, however, that each of the figures is provided for the purpose of illustration and description only and is not intended as a definition of the limits of the broadest conception of the present invention.

DETAILED DESCRIPTION

Applicants have found that molecularly self-assembling (MSA) materials (defined below) can be melt-blown into fibers from a melt of the MSA material at a temperature of from about 130° C. to 220° C. (or about 80° C. to 160° C. lower than some conventional melt-blown polymer melt temperatures) while maintaining adequate fiber production rates and forming fibers and non-woven webs with useful fiber diameters, diameter distributions, and mechanical properties. In some embodiments, the melt is at a temperature of from about 150° C. to 220° C. (or about 80° C. to 140° C. lower than some conventional melt-blown polymer melt temperatures). The invention method produces a set of fibers that have a high percentage of smaller diameter fibers and numerically lower average size distribution of the fiber diameters, That is, the fiber set produced has a distribution of fiber diameters wherein at least about 95% of the fibers have a diameter of less than about 3 microns.

For purposes of United States patent practice and other patent practices allowing incorporation of subject matter by reference, the entire contents—unless otherwise indicated—of each U.S. patent, U.S. patent application, U.S. patent application publication, PCT international patent application and WO publication equivalent thereof, referenced in the instant Summary or Detailed Description of the Invention are hereby incorporated by reference. In an event where there is a conflict between what is written in the present specification and what is written in a patent, patent application, or patent application publication, or a portion thereof that is incorporated by reference, what is written in the present specification controls.

In the present application, any lower limit of a range of numbers, or any preferred lower limit of the range, may be combined with any upper limit of the range, or any preferred upper limit of the range, to define a preferred aspect or embodiment of the range. Unless otherwise indicated, each range of numbers includes all numbers, both rational and irrational numbers, subsumed within that range (e.g., the range from about 1 to about 5 includes, for example, 1, 1.5, 2, 2.75, 3, 3.80, 4, and 5).

In an event where there is a conflict between a compound name and its structure, the structure controls.

In an event where there is a conflict between a unit value that is recited without parentheses, e.g., 2 inches, and a corresponding unit value that is parenthetically recited, e.g., (5 centimeters), the unit value recited without parentheses controls.

As used herein, "a," "an," "the," "at least one," and "one or more" are used interchangeably. In any aspect or embodiment of the instant invention described herein, the term "about" in a phrase referring to a numerical value may be deleted from the phrase to give another aspect or embodiment of the instant invention. In the former aspects or embodiments employing the term "about," meaning of "about" can be construed from context of its use. Preferably "about" means from 90 percent to 100 percent of the numerical value, from 100 percent to 110 percent of the numerical value, or from 90 percent to 110 percent of the numerical value. In any aspect or embodiment of the instant invention described herein, the open-ended terms "comprising," "comprises," and the like (which are synonymous with "including," "having," and "characterized by") may be replaced by the respective partially closed phrases "consisting essentially of," consists essentially of," and the like or the respective closed phrases "consisting of," "consists of," and the like to give another aspect or embodiment of the instant invention. In the present application, when referring to a preceding list of elements (e.g., ingredients), the phrases "mixture thereof," "combination thereof," and the like mean any two or more, including all, of the listed elements. The term "or" used in a listing of members, unless stated otherwise, refers to the listed members individually as well as in any combination, and supports additional embodiments reciting any one of the individual members (e.g., in an embodiment reciting the phrase "10 percent or more," the "or" supports another embodiment reciting "10 percent" and still another embodiment reciting "more than 10 percent."). The term "plurality" means two or more, wherein each plurality is independently selected unless indicated otherwise.

Molecularly Self-Assembling Materials

The term "molecularly self-assembling material" or "molecularly self-assembled material" or "MSA material" means an oligomer or polymer that effectively forms larger associated or assembled oligomers and/or polymers through the physical intermolecular associations of chemical functional groups. Without wishing to be bound by theory, it is believed that the intermolecular associations do not increase the molecular weight (Mn-Number Average molecular weight) or chain length of the self-assembling material and covalent bonds between said materials do not form. This combining or assembling occurs spontaneously upon a triggering event such as cooling to form the larger associated or assembled oligomer or polymer structures. Examples of other triggering events are the shear-induced crystallizing of, and contacting a nucleating agent to, a MSA material. Accordingly, MSA materials can exhibit mechanical properties similar to some higher molecular weight synthetic polymers and viscosities like very low molecular weight compounds. Molecularly self-assembling organization (self-assembly) is caused by non-covalent bonding interactions, often directional, between molecular functional groups or moieties located on individual molecular (i.e. oligomer or polymer) repeat units (e.g. hydrogen-bonded arrays). Non-covalent bonding interactions include: electrostatic interactions (ion-ion, ion-dipole or dipole-dipole), coordinative metal-ligand bonding, hydrogen bonding, π-π-structure stacking interactions, donor-acceptor, and/or van der Waals forces and can occur intra- and intermolecularly to impart structural order. One preferred mode of self assembly is hydrogen-bonding and this non-covalent bonding interactions can be defined by a mathematical "Association constant", K(assoc) constant describing the relative energetic interaction strength of a chemical complex or group of complexes having multiple hydrogen bonds. Such complexes give rise to the higher-ordered structures in a mass of MSA materials. A description of self-assembling multiple H-bonding arrays can be found in "Supramolecular Polymers", Alberto Ciferri Ed., 2nd Edition, pages (pp) 157-158. A "hydrogen bonding array" is a purposely synthesized set (or group) of chemical moieties (e.g. carbonyl, amine, amide, hydroxyl. etc.) covalently bonded on repeating structures or units to prepare a self-assembling molecule so that the individual functional moieties can form self-assembling donor-acceptor pairs with other donors and acceptors on the same, or different, molecule. A "hydrogen bonded complex" is a chemical complex formed between hydrogen bonding arrays. Hydrogen bonded arrays can have association constants K (assoc) between $10^2$ and $10^9$ $M^{-1}$ (reciprocal molarities), generally greater than $10^3$ $M^{-1}$. The arrays can be chemically the same or different and form complexes.

Accordingly, the molecularly self-assembling materials suitable for melt-blowing presently include: self-assembling polyesteramides, copolyesteramide, copolyetheramide, copolyetherester-amide, copolyetherester-urethane, copolyether-urethane, copolyester-urethane, copolyester-urea, copolyetherester-urea and their mixtures. Preferred MSA materials include copolyesteramide, copolyether-amide, copolyester-urethane, and copolyether-urethanes. The MSA material preferably has a number average molecular weight, $MW_n$ (as is preferably determined by NMR spectroscopy) of 2000 grams per mole (g/mol) or more, more preferably at least about 3000 g/mol, and even more preferably at least about 5000 g/mol. The MSA material preferably has $MW_n$ 50,000 g/mol or less, more preferably about 20,000 g/mol or less, yet more preferably about 15,000 g/mol or less, and even more preferably about 12,000 g/mol or less. The MSA material can comprise self-assembling repeat units, preferably comprising (multiple) hydrogen bonding arrays, wherein the arrays have an association constant K (assoc) preferably from $10^2$ to $10^9$ reciprocal molarity ($M^{-1}$) more preferably greater than $10^3$ $M^{-1}$: association of multiple-hydrogen-bonding arrays comprising donor-acceptor hydrogen bonding moieties is the preferred mode of self assembly. The multiple H-bonding arrays preferably comprise an average of 2 to 8, more preferably 4 to 6, and still more preferably at least 4 donor-acceptor hydrogen bonding moieties per self-assembling unit. Self-assembling units in the MSA material can include bis-amide groups, and bis-urethane group repeat units and their higher oligomers.

The MSA materials can include "non-aromatic hydrocarbylene groups" and this term means specifically herein hydrocarbylene groups (a divalent radical formed by removing two hydrogen atoms from a hydrocarbon) not having or including any aromatic structures such as aromatic rings (e.g. phenyl) in the backbone of the oligomer or polymer repeating units. These groups can optionally be substituted with various substituents, or functional groups, including but not limited to: halides, alkoxy groups, hydroxy groups, thiol groups, ester groups, ketone groups, carboxylic acid groups, amines, and amides. A "non-aromatic heterohydrocarbylene" is a hydrocarbylene that includes at least one non-carbon atom (e.g. N, O, S, P or other heteroatom) in the backbone of the polymer or oligomer chain, and that does not have or include aromatic structures the backbone of the polymer or oligomer chain. These groups can optionally be substituted with various substituents, or functional groups, including but not limited to: halides, alkoxy groups, hydroxy groups, thiol groups, ester groups, ketone groups, carboxylic acid groups, amines, and amides. Heteroalkylene is an alkylene group having at least one non-carbon atom (e.g. N, O, S or other heteroatom) that can optionally be substituted with various substituents, or functional groups, including but not limited to: halides, alkoxy groups, hydroxy groups, thiol groups, ester groups, ketone groups, carboxylic acid groups, amines, and amides. For the purpose of this disclosure, a "cycloalkyl" group is a saturated carbocyclic radical having three to twelve carbon atoms, preferably three to seven. A "cycloalkylene" group is an unsaturated carbocyclic radical having three to twelve carbon atoms, preferably three to seven. The cycloalkylene can be monocyclic, or a polycyclic fused system as long as no aromatic structures are included. Cycloalkyl and cycloalkylene groups can be monocyclic, or a polycyclic fused system as long as no aromatic structures are included. Examples of such carbocyclic radicals include cyclopropyl, cyclobutyl, cyclopentyl, cyclohexyl and cycloheptyl. The groups herein can be optionally substituted in one or more substitutable positions. For example, cycloalkyl and cycloalkylene groups can be optionally substituted with, among others, halides, alkoxy groups, hydroxy groups, thiol groups, ester groups, ketone groups, carboxylic acid groups, amines, and amides. Cycloalkyl and cycloalkene groups can optionally be incorporated into combinations with other groups to form additional substituent groups, for example: "-Alkylene-cycloalkylene-, "-alkylene-cycloalkylene-alkylene-", "-heteroalkylene-cycloalkylene-", and "-heteroalkylene-cycloalkyl-heteroalkylene" which refer to various non-limiting combinations of alkyl, heteroalkyl, and cycloalkyl. These can include groups such as oxydialkylenes (e.g., diethylene glycol), groups derived from branched diols such as neopentyl glycol or derived from cyclo-hydrocarbylene diols such as Dow Chemical's UNOXOL® isomer mixture of 1,3- and 1,4-cyclohexanedimethanol, and other non-limiting groups, such -methylcylohexyl-, -methyl-cyclohexyl-methyl-, and the like. The cycloalkyl can be monocyclic, or a polycyclic fused system as long as no aromatic structures are included. "Heterocycloalkyl" is one or more carbocyclic ring systems having 4 to 12 atoms and containing at least one and up to four heteroatoms selected from nitrogen, oxygen, or sulfur. This includes fused ring structures. Preferred heterocyclic groups contain two ring nitrogen atoms, such as piperazinyl. The heterocycloalkyl groups herein can be optionally substituted in one or more substitutable positions. For example, heterocycloalkyl groups may be optionally substituted with halides, alkoxy groups, hydroxy groups, thiol groups, ester groups, ketone groups, carboxylic acid groups, amines, and amides.

A preferred class of MSA materials useful in the presently invention are polyester-amide and polyester-urethane polymers (optionally containing polyether units) such as those described in U.S. Pat. No. 6,172,167, PCT application number PCT/US2006/023450 and publication number WO2007/030791, each of which is expressly incorporated herein by reference.

In a set of preferred embodiments, the MSA material comprises ester repeat units of Formula I:

Formula I

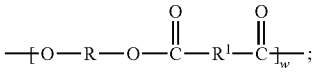

and at least one second repeat unit selected from the esteramide units of Formula II and III:

Formula II

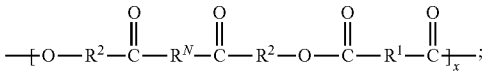

Formula III

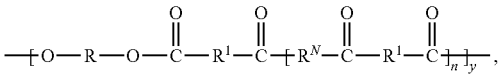

and the ester-urethane units of Formula IV:

Formula IV

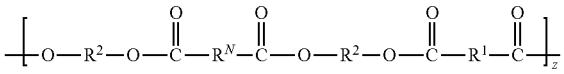

R is at each occurrence, independently a $C_2$-$C_{20}$ non-aromatic hydrocarbylene group, a $C_2$-$C_{20}$ non-aromatic heterohydrocarbylene group, or a polyalkylene oxide group having a group molecular weight of from about 100 to about 5000 g/mol. In preferred embodiments, the $C_2$-$C_{20}$ non-aromatic hydrocarbylene at each occurrence is independently specific groups: alkylene-, -cycloalkylene-, -alkylene-cycloalkylene-, -alkylene-cycloalkylene-alkylene- (including dimethylene cyclohexyl groups). Preferably, these aforementioned specific groups are from 2 to 12 carbon atoms, more preferably from 3 to 7 carbon atoms. The $C_2$-$C_{20}$ non-aromatic heterohydrocarbylene groups are at each occurrence, independently specifically groups, non-limiting examples including: -hetereoalkylene-, -heteroalkylene-cycloalkylene-, -cycloalkylene-heteroalkylene-, or -heteroalkylene-cycloalkylene-heteroalkylene-, each aforementioned specific group preferably comprising from 2 to 12 carbon atoms, more preferably from 3 to 7 carbon atoms. Preferred heteroalkylene groups include oxydialkylenes, for example diethylene glycol (—$CH_2CH_2OCH_2CH_2$—O—). When R is a polyalkylene oxide group it can preferably be a polytetramethylene ether, polypropylene oxide, polyethylene oxide, or their combinations in random or block configuration wherein the molecular weight (Mn-average molecular weight, or conventional molecular weight) is preferably about 250 g/ml to 5000 g/mol, more preferably more than 280 g/mol, and still more preferably more than 500 g/mol, and is preferably less than 3000 g/ml: mixed length alkylene oxides can be also be included. Other preferred embodiments include species where R is the same $C_2$-$C_6$ alkylene group at each occurrence, and most preferably it is —$(CH_2)_4$—.

$R^1$ is at each occurrence, independently, a bond, or a $C_1$-$C_{20}$ non-aromatic hydrocarbylene group. In some preferred embodiments, $R^1$ is the same $C_1$-$C_6$ alkylene group at each occurrence, most preferably —$(CH_2)_4$—.

$R^2$ is at each occurrence, independently, a $C_1$-$C_{20}$ non-aromatic hydrocarbylene group. According to another embodiment, $R^2$ is the same at each occurrence, preferably $C_1$-$C_6$ alkylene, and even more preferably $R^2$ is —$(CH_2)_2$—, —$(CH_2)_3$—, —$(CH_2)_4$—, or —$(CH_2)_5$—.

$R^N$ is at each occurrence can be —$N(R^3)$—Ra-$N(R^3)$—, where $R^3$ is independently H or can be a $C_1$-$C_6$ alkyl, preferably $C_1$-$C_4$ alkyl, or $R^N$ is a $C_2$-$C_{20}$ heterocycloalkylene group containing the two nitrogen atoms, wherein each nitrogen atom is bonded to a carbonyl group according to Formula II or III above; w represents the ester mol fraction, and x, y and z represent the amide or urethane mole fractions where w+x+y+z=1, 0<w<1, and at least one of x, y and z is greater than zero. Ra is a $C_2$-$C_{20}$ non-aromatic hydrocarbylene group, more preferably a $C_2$-$C_{12}$ alkylene: most preferred Ra groups are ethylene butylene, and hexylene —$(CH_2)_6$—. $R^N$ can be piperazinyl. According to another embodiment, both $R^3$ groups are hydrogen.

n is at least 1 and has a mean value less than 2.

In an alternative embodiment, the MSA material can be a polymer consisting of repeat units of either Formula II or Formula III, wherein R, $R^1$, $R^2$, $R^N$, and n are as defined above and x+y=1, and $0 \leqq x \leqq 1$ and $0 \leqq y \leqq 1$.

The polyesteramide according to this embodiment preferably has a molecular weight (Mn) of at least about 4000, and no more than about 20,000. More preferably, the molecular weight is no more than about 12,000.

It should be noted that for convenience the chemical repeat units for various embodiments are shown independently. The invention encompasses all possible distributions of the w, x, y, and z units in the copolymers, including randomly distributed w, x, y and z units, alternatingly distributed w, x, y and z units, as well as partially, and block or segmented copolymers, the definition of these kinds of copolymers being used in the conventional manner. In some embodiments, the mole fraction of w to (x+y+z) units can be between about 0.1:0.9 and about 0.9:0.1. In some preferred embodiments, the copolymer can comprise at least 15 mole percent w units, at least 25 mole percent w units, or at least 50 mole percent w units.

In a preferred embodiment the melt viscosity of the MSA material is less than 500 Pascal-seconds, preferably less than 250 Pa.-seconds, even more preferably less than 100 Pa.-seconds from above Tm (Tm being the polymer melting temperature, preferably as determined by DSC) up to about 40 degrees ° C. above Tm.

In some preferred embodiments, the melt viscosity can exhibit Newtonian behavior, and less than 50 Pa.-.-seconds, preferably less than 25 Pa.-.-seconds, even more preferably less than 10 Pa.-.-seconds from 40 degrees or more above the melt temperature. In a preferred embodiment, the method further comprises a MSA material having a Tm greater than about 60° C. In still some other embodiments the MSA material is characterized by a melt viscosity in the range of from 1 Pascal·second (Pa.-s.) to 50 Pa.-s. at from 150° C. to 170° C. In other embodiments the MSA material is characterized by a melt viscosity in the range of from 0.1 Pa.-s. to 30 Pa.-s. in the temperature range of from 180° C. to 220° C. In still other embodiments, the MSA material is characterized by a melt viscosity in the range of from 0.1 Pascal·second to 10 Pascal·seconds in the temperature range of from 180° C. to 220° C. In still other embodiments, the MSA material is characterized by a melt viscosity having Newtonian behavior over the frequency range of $10^{-1}$ to $10^2$ radians per second at a temperature from above Tm up to about 40° C. above Tm. Further, the MSA material can be characterized by at least one melting point Tm greater than 25° C. and/or the MSA material is characterized by a glass transition temperature Tg greater than −80° C.

The MSA material preferably has a tensile modulus of at least 4 MPa, more preferably at least 15 MPa, and most preferably at least 50 MPa but preferably no more than 500 MPa when the modulus of a compression molded sample of the bulk material is tested in tension at room temperature (approximately 20° C.). From material according to certain preferred embodiments, 2 millimeter (mm) thick compression molded plaques useful for tension-type testing (e.g., "Instron" tensile testing as would be know in the art) are produced. Prior to compression molding, the materials are dried at 65° C. under vacuum for about 24 hours. Plaques of 160 mm×160 mm×2 mm are obtained by compression molding isothermally at 150° C., 6 minutes at 10 bar (about 1.0 MPa) and 3 minutes at 150 bar (about 15 MPa). The samples are cooled from 150° C. to room temperature at a cooling rate of 20° C./minute.

Melt-Blown Materials Processing

"Melt-blowing" is a process or technique for producing fibrous non-woven webs and non-woven articles directly from molten polymers or resins using moving air or gas to draw filaments from a die onto a collector or moving conveyor belt. A schematic for melt-blowing for producing fibers, including micro-fibers, is shown in FIG. 1. The melt-blowing process system of FIG. 1 includes: a die tip 1, an air knife assembly 2, and an air or Stretch Air jet stream 3. The "melt-blowing stretch air temperature" or "stretch air temperature" is the temperature of flowing air used to convey a melt stream of an extruded material which solidifies prior to reaching the conveyor belt. Due to the volume of air and air pressure used, the temperature of the air is typically measured where the air is stored in air chambers (not shown) before it gets to the air knife. It can be higher, the same, or less than the polymer melt temperature of the melt-blown material. The device preferably further comprises a conveyor belt 4 for fiber/web take-up that receives fiber 5 and conveys it away as a non-woven web. Descriptively, the conventional melt blowing process is generally a two-step process in which the high-velocity air 3 blows past air-knife 2 to entrain or pull a molten material, often a thermoplastic resin, from the extruder die tip 1 onto the conveyor 4 (also called a "take-up screen") thereby forming a fibrous and self-bonding web.

The invention herein may use any melt blowing system but preferably uses specialized process melt-blowing systems produced by Hills, Inc. of West Melbourne, Fla. 32904. See e.g. U.S. Pat. No. 6,833,104 B2, and WO 2007/121458 A2 the teachings of each of which are hereby incorporated by reference. See also www.hillsinc.net/technology.shtml and www.hillsinc.net/nanomeltblownfabric.shtml and the article "Potential of Polymeric Nanofibers for Nonwovens and Medical Applications" by Dr John Hagewood, J. Hagewood, LLC, and Ben Shuler, Hills, Inc, published in the 26 Feb. 2008 Volume of Fiberjournal.com. Preferred dies have very large Length/Diameter flow channel ratios (L/D) in the range of greater than 20/1 (also represented as 20:1) to 1000/1, preferably greater than 100/1 to 1000/1, that can also be incrementally produced, for example but not limited to L/D values including: 150/1, 200/1, 250/1, 300/1 and the like so long as there is sufficient polymer melt back pressure at a given polymer melt flow rate from the die so as to establish substantially even polymer flow distribution. Additionally, the die spinholes ("holes") are typically on the order of 0.05 mm to 0.2 mm in diameter.

As the flow die channel diameter (D) decreases, the die channel length (L) increases, the polymer melt flow rate increases, or a combination thereof, the polymer melt back pressure undesirably increases. For any particular L/D geometry of a die and any particular polymer melt flow rate, the polymer melt back pressure can be characterized by a term "die effective viscosity." Calculation of the die effective viscosity uses the Hagen-Poiseuille equation to determine a viscosity from the polymer back pressure in a melt blowing process. For the die, the die effective viscosity (μ), expressed in Pascal·seconds, equals polymer melt back pressure ($\Delta P^m$) in Pascals times the square of channel cross sectional area ($A^2$) in square meters divided by the volumetric polymer melt flow rate (Q) in cubic meters per second and divided by the channel length (L) in meters and divided by 8 pi ($\pi$). Thus, the die effective viscosity is calculated using the equation, $\mu=\Delta P'''A^2/(8\pi QL)$.

Preferably, the invention method employs a melt blowing die having a plurality of channels, each channel independently being characterizable as having a die expected viscosity ($\mu$) of from 0.1 Pascal·second to less than 12 Pascal·seconds, more preferably less than 10 Pascal·seconds, and still more preferably less than 8 Pascal·seconds.

In one embodiment, the (melt-blown material) melt temperature is about 120° C. or greater, in another embodiment the melt temperature is about 150° C. or greater, and in still another embodiment, the melt temperature is 160° C. or greater. In another embodiment the melt temperature is preferably 220° C. or lower, more preferably, 200° C. or lower, and most preferably, 180° C. or lower, which can be measured by thermocouple or other suitable device that is known for measuring the temperature of polymer in the melt state, preferably as used in the melt-blowing art.

In still another embodiment, melt-blowing is at a rate, expressed in kilograms of melt-blown polymer produced per hour per meter width of die, of about 0.5 kilogram/hour/meter (kg/hr/m) or more, preferably about 1.0 kg/hr/m, more preferably about 2.5 kg/hr/m, even more preferably about 5 kg/hr/m, even more preferably about 10 kg/hr/m, and most preferably melt-blowing is at a rate of 25 kg/hr/m. In other embodiments of the method, melt-blowing is 75 kg/hr/m or less, more preferably, 60 kg/hr/m or less, and most preferably 50 kg/hr/m or less. In still another embodiment of the method, the melt-blowing stretch air temperature is 100° C. or more, preferably 150° C. or more, and most preferably, 170° C. or more. In other embodiments, the melt-blowing stretch air temperature is 300° C. or less, preferably 250° C. or less, more preferably 225° C. or less and most preferably about 200° C. or less.

In some embodiments, the melt-blowing rate preferably is about 0.0005 gram of melt-blown polymer produced per spinhole per minute of melt blowing time (i.e., gram/hole/minute) or more. Preferably such embodiments employ a die having a spinhole density of 200 holes per inch.

In some embodiments, the melt-blowing rate, expressed in grams of melt blown polymer produced per spinhole per minute, preferably is about 0.004 gram/hole/minute or more; more preferably about 0.01 gram/hole/minute or more; still more preferably about 0.02 gram/hole/minute or more; even more preferably about 0.04 gram/hole/minute or more; and even more preferably 0.11 gram/hole/minute. In some embodiments, the melt-blowing rate is 0.32 gram/hole/minute or less; in other embodiments, 0.26 gram/hole/minute or less; and in still other embodiments 0.21 gram/hole/minute or less. Preferably such embodiments employ a die having a spinhole density of 100 holes per inch.

In some embodiments, the melt of the MSA material is extruded under a polymer melt back pressure of from 0.95 megapascals to 5.5 megapascals, and preferably from 0.97 megapascals to 3.3 megapascals.

In a preferred embodiment, the method further comprises collecting the fibers as a fiber set so as to form a fibrous non-woven web. The web dimensions can be varied and the density of material can change depending on the speed of the melt-blowing production and the fiber size and distribution(s). In certain preferred embodiments, the web speed can be greater than about one meter per minute, preferably greater than about four meters/minute, more preferably about nine meters/minute, still more preferably about 20 meters/minute and most preferably about 35 meters per minute. The fiber diameter sizes can range from about 0.02 micron to about 13 microns (e.g., from about 0.1 micron to about 13 microns). The method further comprises producing fibers having a size distribution wherein at least about 95% of the fibers are less than about 3.0 microns in diameter, preferably, wherein about 85% of the fibers have diameters of less than about 2.0 microns, more preferably wherein about 65% of the fibers are less than about 1.0 micron in diameter, and most preferably wherein about 35% of the fibers are less than about 0.5 micron in diameter. The fibers prepared by the method described generally can have an average diameter of about 1.5 microns, preferably about 0.80 microns or less, and still more preferably about 0.65 micron or less.

In another aspect of the invention, the method further comprises an article comprising or prepared from the melt-blown fibers formed using the method of any one of the preceding embodiments or aspects. Useful articles include: garments, cloths and fabrics, gas and liquid filters and stock, papers, geotextiles, construction compositions and fabrications, coatings, synthetic animal hides, electronic components, composites, films and film precursors, absorptive wipes or medical implants and devices, hygiene (diaper coverstock, adult incontinence, training pants, underpads, feminine hygiene), industrial garments, fabric softeners, home furnishings, automotive fabrics, coatings and laminating substrates, agricultural fabrics, shoes and synthetic leather.

In one embodiment, the article is a mechanical particulate filter media, the mechanical particulate filter media comprising media fine fibers fabricated according to the invention melt blowing method. A mechanical particulate filter media is a type of particulate filter that is not initially electrostatically charged to improve particulate filtering from an air or gas stream. For example, many conventional polypropylene air filters are initially electrostatically charged to improve initial filtering efficiency and capacity. But this charge dissipates over time and the filtering ability of the media subsequently decreases.

The melt-blown media preferably has a non-woven basis weight of from about 0.08 gram per square meter to about 300 grams per square meter (e.g., 0.25 gram per square meter to about 300 grams per square meter), and a fiber diameter distribution wherein about 95 percent of the media fibers have diameter of less than about 3.0 microns. In a preferred embodiment, the media fibers preferably has an average diameter less than about 1.0 micron, and in a most preferred embodiment, media fibers can have an average diameter less than about 0.75 microns.

These media can be assembled into gas or air filters, and in certain embodiments, can have a Frazier Permeability (defined as the air permeability at a pressure drop $\Delta P$ of 0.5 inch water) of from at least about 30 feet/minute, more preferably about 50 feet/minute, still more preferably about 140 feet/minute, and most preferably about 760 feet/minute. The filter media can have a MERV rating of from 5 to 14, and in some embodiments from 5 to 13. In some embodiments, the MERV rating is 5, preferably 8, and more preferably 13. The media can have an alpha-value ($\alpha$-value) of from about 1.8, preferably about 11, more preferably about 15, still more preferably about 17, and most preferably about 23.

MERV is the Minimum Efficiency Reporting Value, expressed as an integer, and is the ASHRAE (American Society of Heating, Refrigerating and Air-Conditioning Engineers) rating standard for efficiencies of air filters. The $\alpha$-value is the $(-\log_{10}(1\text{-efficiency}))/\Delta P\times 100$ (wherein $\Delta P$ is the pressure drop in millimeters water ($mmH_2O$) through the filter media): it is a standard industry calculation for showing the ratio of efficiency and the pressure drop through a filter element.

In some embodiments, the melt-blown media exhibit a (mechanical) elongation of from about 25% or more, preferably 50% or more, but according to one preferred embodiment not more than about 90%, and a tensile strength of from about 2 Newtons/5 centimeters, to about 10 N/5 cm.

Particulate filters comprising a web of the media fine fibers can be constructed using conventional means and devices. A particulate filter comprising the web of media fine fibers can further comprise a supporting structure wherein the media fine fibers are deposited thereon. The supporting structure can be a relatively rigid material to hold the web of media fine fibers and is a polymeric, metallic, fiberglass, ceramic, cellulosic material, or a combination thereof. The support structure does not substantially retard (i.e., reduce by 20% or more, preferably reduce by less than 10%, more preferably less than 5%, and still more preferably less than 2%) airflow through the media and is a conventional support structure. The particulate filter can further comprise a housing for carrying and holding the support structure and the web of media fine fibers, and the housing can be adapted for reversible insertion into an air stream filtering system for removing particulates therefrom. The filter can be constructed for suitable insertion into an air stream filtering system for removing particulates therefrom according to conventional methods and configurations. There is no particular limitation as to the kind of air or gas stream into which the particulate filter can be introduced or from which it can remove particulates.

PREPARATIONS

Preparation 1: Preparation of ethylene-N,N"-dihydroxyhexanamide (also interchangeably referred to herein as "C2C" and "Diamide-diol")

The amide diol ethylene-N,N"-dihydroxyhexanamide monomer batch is prepared by reacting 1.2 kg ethylene diamine (EDA) with 4.56 kg of ϵ-caprolactone under a nitrogen blanket in a stainless steel reactor equipped with an agitator and a cooling water jacket. An exothermic condensation reaction between the ϵ-caprolactone and the EDA occurs which causes the temperature to rise gradually to 80 degrees Celsius (° C.). A white deposit forms and the reactor contents solidify, and the stirring is stopped. The reactor contents are cooled to 20° C. and are allowed to rest for 15 hours. The reactor contents are heated to 140° C. at which temperature the solidified reactor contents melt. The liquid product is then discharged from the reactor into a collecting tray. A proton nuclear magnetic resonance study of the resulting product shows that the molar concentration of Diamide-diol in the Diamide-diol product exceeds 80 percent. The melting point of the Diamide-diol (C2C) product is 140° C.

Preparation 2. Preparation of MSA copolyesteramide with 53 mole % amide (C2C) residual content (C2C 53 mol %)

(a): preparation of ethylene-N,N"-dihydroxyhexanamide ("C2C" and "Diamide-diol")

The Diamide-diol (i.e., C2C) is prepared in a manner similar to that which is described previously in Preparation 1.

(b) preparation of C2C 53 mol % copolyesteramide

In general the synthesis is characterized by the reaction of the Diamide diol (i.e., ethylene-N,N"-dihydroxyhexanamide) with dimethyl adipate (DMA) and 1,4-butanediol (1,4-BD or BD). In a preheated kneader reactor DTB 63 BM (LIST AG, CH-4422 Arisdorf, Switzerland) connected with a vacuum unit 28.90 kg C2C are dried for two hours under vacuum at 132° C. After that the C2C is mixed with 34.91 kg DMA and 16.80 kg (2-fold excess) 1,4-butanediol (BD or 1,4-BD), (40 rpm) under nitrogen. The temperature is then slowly brought to 145° C. until the mixture is clear. At this temperature a 10% by weight solution of titanium tetrabutoxide ($Ti(BuO)_4$) catalyst in BD (4000 ppm calculated on DMA: 140 g catalyst and 1260 g BD, total amount of BD is 18.06 kg) is added. After addition of the catalyst is complete, methanol distillation is started immediately and continued at ambient pressure for 4.18 hours. During this time the kneader temperature is increased slowly to 180° C. After this period the receiver for the distillate is emptied and the reaction continued by gradually applying a vacuum. Within about 1 hour the vacuum is increased to about 10 mbar. Before further lowering the pressure, collected distillate is combined with the previous fraction. In total 14.30 kg methanol fractions are collected. The polycondensation process is continued for about 7 hours at 190° C. The total reaction time in vacuum is 11.32 hours. In total 7.97 kg 1,4-butanediol fractions are collected during this period. After viscosity of 1700 milliPascal·seconds (mPa.-s) to 2100 mPa.-s (180° C.) is reached, the kneader is discharged and granules are produced to give 57.33 kg of C2C 53 mol % copolyesteramide. Analysis of the granules: zero shear viscosity at 180° C.: 1635 mPa.-s (i.e., 1.6 pascal seconds), Mn ($^1$H-NMR): from 4800 g/mol to 5000 g/mol, C2C-residual content (H-NMR): 52.73 mol %.

Preparation 3—Preparation of high MFI melt-blown grade polypropylene resin.

A 25 MFI homo-polypropylene (hPP) fiber resin is treated with 1.5 weight percent of Ciba® IRGATEC® CR 76, a controlled-rheology product for producing melt-blown fabrics, to yield an approximately 1800-2000 MFI melt-blown resin. Ciba® IRGATEC® CR 76 is used for controlled polypropylene degradation to produce high melt flow index materials. MFI values over 2000 MFI can be obtained. MFI can be measured by ASTM method D 1238 REV C Standard Test Method for Melt Flow Rates of Thermoplastics by Extrusion Plastometer or its equivalent.

MFI 1800 hPP is characterized as having a zero shear viscosity at 210° C. of 16.2 pascal seconds; and at 250° C. of 8.3 pascal seconds on an Ares rheometer (T.A. Instruments). Ares rheometer is equipped with a dual range force rebalance transducer capable of torque measurements between 0.02 g-cm and 2000 g-cm; a 31 mm disposable aluminum cup; and a 25 mm aluminum top plate. Set at a gap of approximately 1.5 mm. Run all samples with no initial static force on the sample. Control and monitor temperature using a Sample Tool PRT (platinum resistance thermocouple). Dynamic Frequency Sweep 220° C., 250° C.—place about 1.0 g of sample into a pan that has been previously equilibrated for 20 minutes to 30 minutes at 220° C. and at 250° C.; equilibrate the samples for 20-30 minutes before starting experiment; and perform a frequency sweep using a frequency of 0.1 radian per second (rad/sec) to 100 rad/sec with an applied strain of 100%. Dynamic Temperature Ramp—place about 1.0 g of sample into a pan at 175° C.; equilibrate sample for 20 minutes to 30 minutes; ramp temperature from 175° C. to 260° C. at 3° C./minute; and use a fixed frequency of 1 Hertz (Hz) with an applied strain of 100%. Employ a thermal expansion coefficient to correct for tool expansion during temperature ramps.

An Oerlikon Neumag Melt-blown Technology™ (M&J technology) system is used. The controlled reaction to form the melt-blown polypropylene resin occurs on-line while the (non-woven) melt-blown process line is at a temperature of from 250° C. to 350° C. The melt-blown fibers/non-woven webs are produced conventionally using this approximate temperature range. These fibers are captured continuously in-line during the process on a web-belt which allow the melt blown web to be formed.

Some information about melt blowing the MFI 1800 h-PP is included below in the below Examples and Comparative Example 1 (described later) for convenience and does not mean that melt blowing the MFI 1800 h-PP is part of the present invention.

EXAMPLES

Example 1

Preparation of MSA Copolyesteramide with 50 Mole % Amide (C2C) Residual Content (C2C 50 mol %)

1. Reactor Preparation

A 100 Liter single shaft Kneader-Devolatizer reactor equipped with a distillation column and a vacuum pump system is nitrogen purged/padded and heated to 80° C. (based on thermostat). Dimethyl adipate (DMA), 38.324 kg and Di-amide-diol monomer, 31.724 kg from Preparation 1 are fed into the kneader. The slurry is stirred at 50 rpm. 1,4-Butanediol (BD), 18.436 kg is added to the slurry at a temperature of about 60° C. The reactor temperature is further increased to 145° C. to obtain a homogeneous solution.

2. Distillation of Methanol (Transesterification Reaction)

Still under nitrogen padding, Titanium(IV) butoxide catalyst, 153 g in 1.380 kg BD is injected at a temperature of 145° C. in the reactor and methanol evolution starts. The temperature in reactor is slowly increased to 180° C. in 1.75 hours and is held for 45 additional minutes to complete the methanol distillation at ambient pressure. 12.664 kilograms of methanol is collected.

3. Distillation of 1,4-Butanediol (Polycondensation Reaction)

The reactor dome temperature is increased to 130° C. and the vacuum system activated stepwise to a reactor pressure of 7 mbar in 1 hour. Temperature in the kneader/devolatizer reactor is kept at 180° C. Then the vacuum is increased to 0.7 mbar for 7 hours while the temperature is increased to 190° C. The reactor is kept for 3 additional hours at 191° C. and with vacuum ranging from 0.87 to 0.75 mbar. At this point a sample of the reactor contents is taken (sample 1); melt viscosities were 6575 mPa.-s @ 180° C. and 5300 mPa.-s @ 190° C. The reaction is continued for another 1.5 hours until the final melt viscosities were recorded as 8400 mPa.-s @ 180° C. and 6575 mPa.-s @ 190° C. (sample 2). Then the liquid Kneader/Devolatizer reactor contents were discharged at high temperature of about 190° C. into collecting trays, the polymer was cooled to room temperature and grinded. Final product is 57.95 kg (87.8% yield) of melt viscosities 8625 mPa.-s @ 180° C. and 6725 mPa.-s @ 190° C. (sample 3). Table 1 shows the melt viscosity of all samples collected.

TABLE 1

Melt viscosities and molecular weights of samples of MSA Copolyesteramide

| Hours in full vacuum* | Sample | Spindle No. 28** [rpm] | Viscosity @ 180° C. [mPa · s] | Viscosity @ 190° C. [mPa · s] | Mn, 1 H NMR |
|---|---|---|---|---|---|
| 10 | 1 | 20 | 6575 | 5300 | 6450 |
| 11.5 | 2 | 20 | 8400 | 6575 | 6900 |
| 11.5 | 3 | 20 | 8625 | 6725 | 7200 |

*Vacuum < 1.2 mbar

**Viscometer used: Brookfield DV-II+ Viscometer ™

Examples 2a to 2c

Melt Blowing C2C 50 Mol % Copolyesteramide

The procedure of Example 8 (described later) is repeated except using another batch of C2C 50 mol % copolyesteramide instead of the C2C 50 mol % copolyesteramide of Example 1 or the C2C 53 mol % copolyesteramide of Preparation 2. The other batch of C2C 50 mol % copolyesteramide is prepared by a method similar to that of Preparation 2. The other batch of C2C 50 mol % copolyesteramide has Mn of about 5000 g/mol (by $^1$H-NMR); and a zero shear viscosity at 180° C. of 1.34 pascal seconds after granulation. Thus, the procedure gives melt blown fibers. The C2C 50 mol % copolyesteramide is melt-blown into web at melt temperature of about 144° C., about 167° C., and about 166° C., respectively; and the stretch air temperature is between about 150° C. and 188° C. Extrusion pressures, as preferably measured as melt pump back pressures, are 360 psi, 1230 psi, and 800 psi (i.e., 2.5 megapascals (MPa), 8.5 MPa, and 5.5 MPa). The melt blown fibers are deposited on a typical porous, spun bonded, bi-component polyethylene/polypropylene substrate, having a basis weight about 25 grams per square meter: the substrate moves relative to the blown web deposition of each sample at about 3.5 meters/minute, 21.5 meters per minute, and 11.56 meters/minute for Examples 2a to 2c, respectively. Three sets of fibers are prepared. Melt-blowing rates are: Example 2a: 0.0033 grams/minute/spinhole or 0.78 kilogram per hour per meter (kilogram/hour/meter or, interchangeably, kilogram/hour/meter); and Examples 2b 0.015 grams/minute/spinhole, or 3.5 kilogram/hour/meter; and Example 2c: 0.0093 grams/minute/spinhole, or 2.2 kilogram/hour/meter. The median fiber diameter distribution sizes for the fibers of Examples 2a to 2c are determined as described later in Example 3 and are 0.31 micron, 0.45 micron, and 0.37 micron.

Example 3

Melt-Blowing MSA and Non-Invention Melt Blowing High MFI Polypropylene

An Oerlikon Neumag Melt-blown Technology™ (M&J technology) system is used to prepare fibers and non-woven webs: it is generally a conventional melt-blown web producing line. A suction device to prevent fiber-flow, capability of electrostatic charging of the fiber-curtain can be included, and means for injecting liquids and powders into a fibrous web: these devices add to the basic functionality of the basic melt-blowing process disclosed in FIG. 1. The die has a hole density of 55 holes/inch (about 21 to 22 holes/cm), but the hole density can be higher or lower depending on the non-woven desired. The beam length that defines the web width has a die spinhole or hole diameter of 0.3 mm and an L/D ratio of 10. A 100 mesh screen pack is used in the die block for polymer filtering. The melt-blown process line is started using a standard/typical melt-blown grade of polymer, for example, from Exxon or other known manufacturer. The polymer melt temperature is decreased from the standard melt processing temperature of from 282° C. to 299° C. to a melt temperature of 177° C. and during this change over the system is purged in order to prepare the introduction of the MSA material at a polymer melt temperature of 190° C. allowing for a smooth changeover. The MSA materials have high moisture content and are dried at about 80° C. for 2 hours in a ventilating silo/dryer to reduce moisture so the materials can be melt-blown.

Both an MSA Diamide-diol based copolyesteramide and the 1800-2000 melt index (MFI) viscosity-broken modified polypropylene are run in the process and fibers melt-blown. The MSA Diamide-diol is melt-blown at 170° C. melt temperature and stretch air temperature, and the polypropylene is run at from 275° C. to 300° C. melt temperature and stretch air temperature. The basis weight of the melt-blown non-woven web is obtained by setting the line speed in accordance with the throughput of the process in order to obtain the desired basis weight (or weight basis) of the web; for example, 10 grams per square meter (GSM), 25 GSM, and 50 GSM or more.

Sample Preparation and Fiber Size and Distribution Determination of by Scanning Electron Microscope (SEM).

Figure 2:
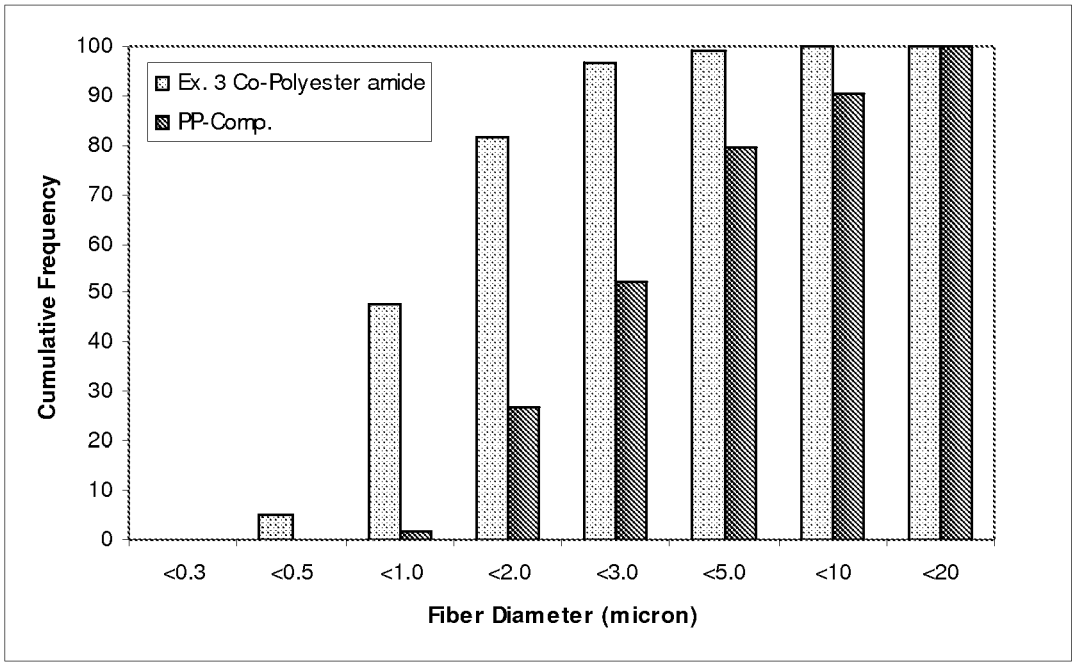
FIG. 2 is a bar chart of cumulative fiber size distributions from Example 3.

Fiber sizes are determined by SEM microscopy. Pieces of melt-blown material are cut and glued to aluminum SEM stubs with carbon paint. The samples are coated with 5 nm of osmium using a Filgen Osmium Plasma Coater OPC-60A. They are imaged in an FEI Nova NanoSEM field emission gun scanning electron microscope (serial #D8134) at 5 keV, spot size 3, and a working distance of 5 mm. Depending on the size of the fibers, 5-20 images are collected at various magnifications for the purposes of measuring fiber diameters. At least one hundred measurements of fiber diameters are taken of each sample using various numbers of images depending on fiber density using ImageJ® image analysis software, then binned and graphed using Excel. FIG. 2 compares the fiber size and size distribution of the MSA material and the high melt index viscosity broken polypropylene: the MSA material yields a smaller average size and lower numerical size distribution.

Example 4

Figure 3:
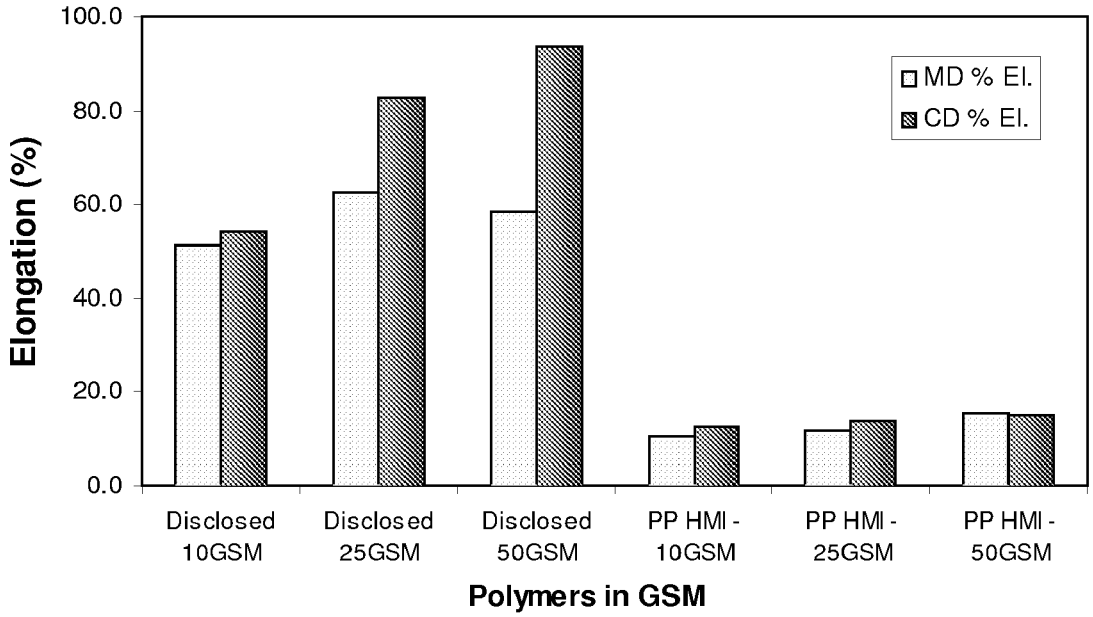
FIG. 3 is a bar chart of elongation of the webs within the scope of the invention as compared to MFI polypropylene webs.
Figure 4:
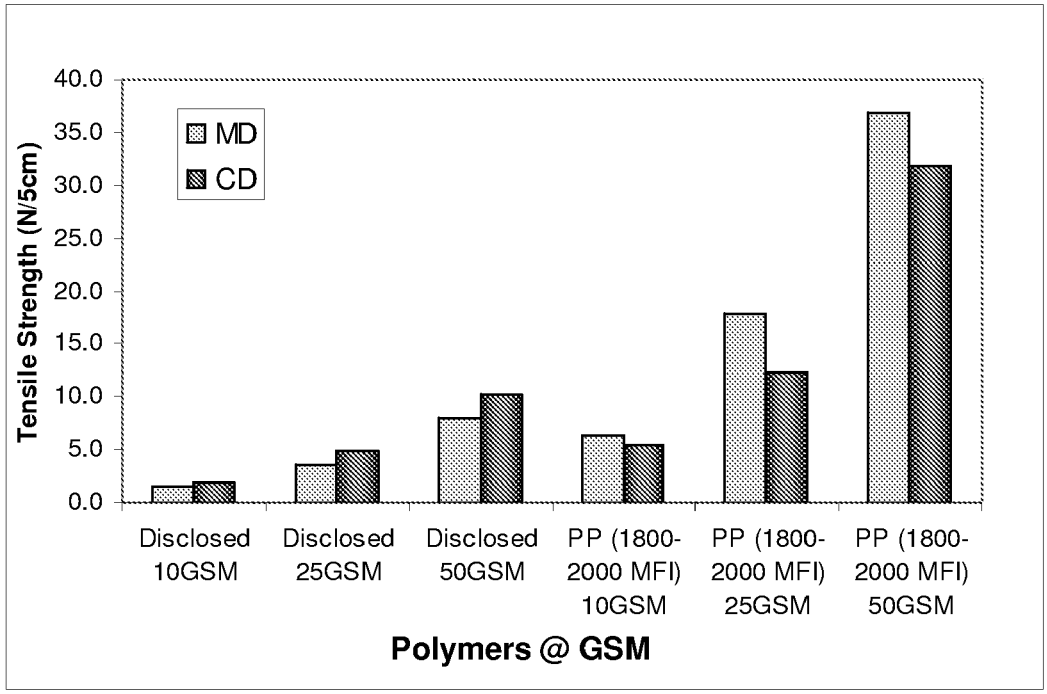
FIG. 4 is a bar chart of the tensile strength of webs within the scope of the invention as compared high MFI polypropylene web tensile strength

Mechanical Properties of Melt Blown MSA Diamide-Diol Based Copolyesteramide Web A comparison of the typical mechanical properties of the MSA Diamide-diol based-copolyesteramide and the 1800-2000 melt index (MFI) viscosity-broken modified polypropylene are shown in FIGS. 3 and 4, the figures illustrate melt-blown machine-direction (MD) and cross-direction (CD) mechanical properties at the same non-woven basis weights. The basis weights of the melt-blown non-woven web are obtained by normal experimentation with melt-blowing machine settings (e.g. varying throughput per die hole, web conveyor belt speed) in order to obtain the desired basis weight (or weight basis) of the web; for example, 10 grams per square meter (GSM), 25 GSM, and 50 GSM. Basis weight is the mass per unit area of a melt blown web, e.g. grams/$m^2$. The mechanical properties of the MSA material show good extensibility and tensile strength, shown in FIG. 3 and FIG. 4 illustrate representative mechanical properties of melt-blown non-woven webs.

Example 5

Melt-Blowing MSA Copolyesteramide of Example 1 to Prepare Sub-Micron Fibers

Melt-blown fibers having submicron diameters were prepared using a proprietary melt-blowing system manufactured, and operated by Hill's Incorporated of West Melbourne, Fla. 32904, described above.). The Hills melt-blown system is preferred and includes extrusion and material transfer manifolds that connect to the proprietary melt-blown die system. A melt pump feeds a melt of a material to be melt blown from a source thereof through the extrusion manifold to a die defining a plurality of die spinholes. The die spinhole (e.g. "hole") density is 100 holes per inch (but can apparently be larger or smaller), and each hole has a diameter of 0.1 mm and a length to diameter ratio (L/D) of greater than 100/1. The melt-blown process line is stated to run using a standard/typical high melt flow melt-blown grade of polypropylene on the Hill's website disclosure. The MSA Diamide diol-copolyesteramide from Example 1 is run in the Hills process and fibers are melt-blown into non-woven webs. The polymer has a Mn of about 7200 grams/mole as estimated by NMR. The concentration of hard segments in the Diamide diol copolyesteramide is 50 mole % amide residual content. The dynamic viscosity of the polymer at 180° C. was about 8,600 mPa.-s and is the same material disclosed in Example 1, above.

Figure 5:
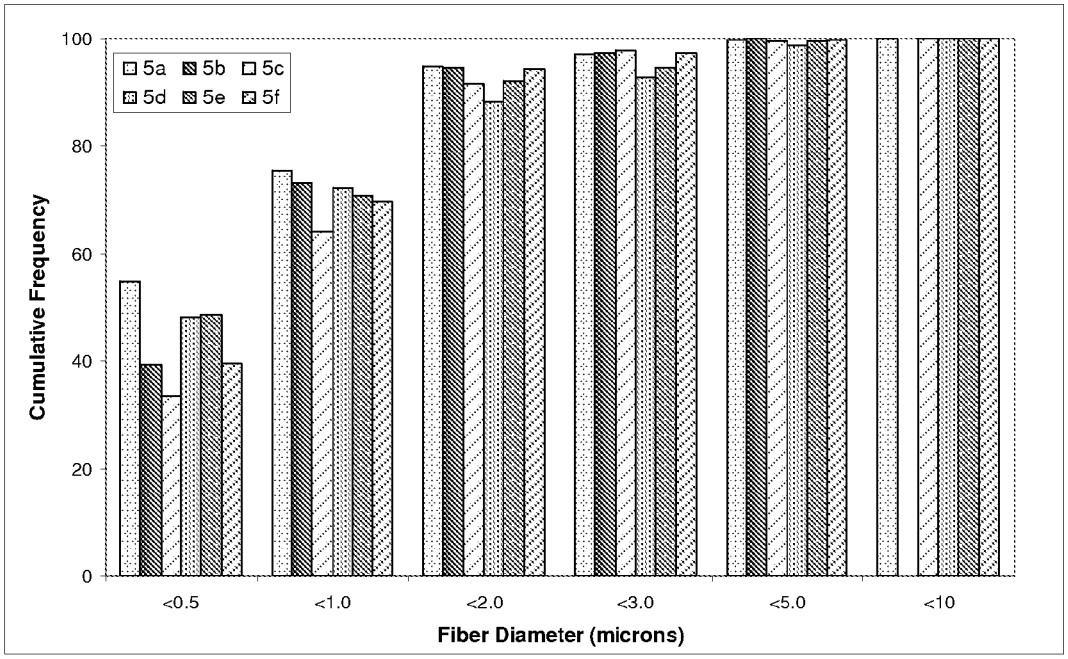
FIG. 5 is a bar chart of fiber size cumulative distribution from Example 5.

The MSA material is melt-blown into web at melt temperature of from about 158° C. to about 174° C. and the stretch air temperature is between about 210° C. and 225° C. The melt blown fibers were deposited on a typical porous, spun bonded, bi-component polyethylene/polypropylene substrate, having a basis weight about 25 grams per square meter: the substrate moves relative to the blown web deposition of each sample at about: a. 8.7 meters/min, b. 8.6 meters/minute, c. 18.2 meters/minute, d. 33.9 meters/minute, e. 5.0 meters/minute, f. 4.8 meters/minute. Six sets of fibers are prepared: non-woven web and filter properties are disclosed in Table 2. The melt-blowing rates are: Sample 5a: 0.0077 grams/minute/spinhole or 1.8 kilograms/hour/meter; Samples 5b-5e: 0.0092 grams/minute/spinhole, or 2.17 kilogram/hour/meter; and for Sample 5f: 0.011 grams/minute/spinhole or 2.6 kilogram/hour/meter. The fiber diameter distribution sizes are disclosed in FIG. 5. Media samples of dimensions 5 inch×5 inch are prepared and tested as described later in Example 6.

Example 6

Filter Media Using the MSA Diamide Diol Copolyesteramide

Using various basis weight non-woven webs from Example 4 and Example 5, filter media were fabricated and tested to determine typical conventional filter properties. The MSA material media was tested as a "mechanical particulate filter media." The various media from Examples 4 and 5 are found to have a basis weight of from about 0.25 GSM to about 300 GSM, and a fiber diameter distribution ranging from about 0.12 micron (μm) to about 12 μm. The Frazier Permeability as determined by ASTM D-737 or ISO-11155 from the media is about 34 feet/minute to about 500 feet/minute and the MERV rating is from 5 to about 13. MERV is the Minimum Efficiency Reporting Value measured with Standard ASHRAE 52.2, the teaching of which is hereby expressly incorporated by reference, and is the rating standard for efficiencies of filters. The media can have α-values from about 1.8 to about 23.2. The α-value is the $(-\log_{10}(1-\text{efficiency}))/\Delta P\times 100$ (where ΔP is the pressure drop in millimeters water ($mmH_2O$) through a filter): it is a standard industry calculation for showing the ratio of efficiency and the pressure drop through a filter element. The efficiency of the media is measured over the standard ASHRAE range of particle sizes and the average of these efficiencies is called the average efficiency and is used in the α-value calculation.

For each of the fibers of Examples 5a to 5f, 5 inch×5 inch were cut from rolls of the non-woven, melt blown MSA material media to determine the basis weight: no less than 5 samples are weighed on a Mettler AE260 balance to 0.0001 gram. Samples are prepared and tested at room temperature two weeks after made to determine filter properties. Samples are deposited on 25 grams per square meter (gsm or grams/$m^2$ or g/$m^2$) basis weight of spun-bonded bi-component polyethylene/polypropylene (PE/PP) substrate to respectively give Examples 6a to 6f. The definitions for the quantities in Table 2 are given previously. The pressure drops are measured at 10 feet per minute media face velocity. The Frazier Permeability is calculated by measuring the pressure at 5 different media face velocities between 10 feet per minute and 50 feet per minute and using a linear fit to calculate the velocity at which the pressure drop would be 0.5 inch $H_2O$.

TABLE 2

| Example | Basis Weight-(grams/$m^2$) | Average Diameter (microns) | MERV Rating | Frazier Permeability (ft/min) | Pressure Drop (mm $H_20$) | Alpha Value |
|---|---|---|---|---|---|---|
| 6a | 2.7 | 0.67 | 8 | 138 | 0.9 | 17.7 |
| 6b | 3.5 | 0.72 | 8 | 120 | 1.05 | 23.1 |
| 6c | 1 | 0.82 | 6 | 327 | 0.35 | 23.2 |
| 6d | 0.25 | 0.82 | 5 | 508 | 0.25 | 17.1 |
| 6e | 11 | 0.69 | 12 | 47 | 2.6 | 15.3 |
| 6f | 12 | 0.74 | 12 | 38 | 3.3 | 14.9 |
| PE/PP substrate | 25 | N/a* | 5 | 706 | 0.18 | 25.9 |

*N/a means not available

Example 7

Copolyesteramide Filter Media Using 17 GSM Polyester Substrate

The copolyesteramide from Example 1 is run in the same Hills process as Example 5. The melt blown fibers are deposited on a conventional, spun bonded, polyester-based substrate having an approximate basis weight of about 17 grams per square meter (gsm). The substrate moves relative to the blown web deposition at about 21.7 meters/minute for Sample a, and 6.6 meters/minute for Sample b. The melt-blowing rates are 0.005 grams/minute/spinhole for Sample a, and 0.017 grams/minute/spinhole for Sample b. Two sets of fibers are prepared and their non-woven web and filter properties are disclosed in Table 3. The pressure drops are measured at 107 feet per minute media face velocity. Sample properties are disclosed in Table 3.

TABLE 3

| Example | Basis Weight-(grams/$m^2$) | MERV Rating | Frazier Permeability (ft/min) | Pressure Drop (mm $H_20$) | Alpha Value |
|---|---|---|---|---|---|
| 7a | 2.2 | 5 | 761 | 1.5 | 7.7 |
| 7b | 16 | 13 | 70 | 20.1 | 4.1 |
| 7c (substrate) | 17 | 1 | N/a* | N/a | N/a |

*N/a means not available

Examples 8a to 8e

Melt Blowing C2C 53 Mol % Copolyesteramide

The procedure of Example 5 is repeated except using the C2C 53 mol % copolyesteramide of Preparation 2 instead of the C2C 50 mol % copolyesteramide of Example 1. As mentioned previously, the C2C 53 mol % copolyesteramide of Preparation 2 has a Mn of 5000 grams/mole as estimated by 1H-NMR. The procedure gives melt blown fibers of Examples 8a to 8e.

Figure 6:
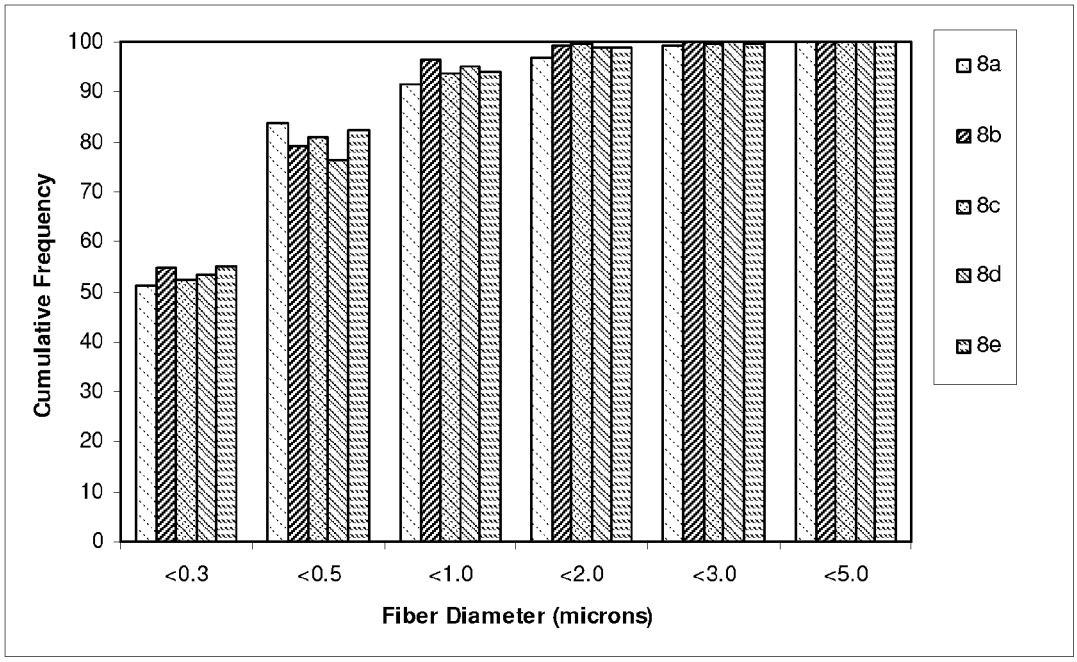
FIG. 6 is a bar chart of fiber size cumulative distribution from Example 8.

The C2C 53 mol % copolyesteramide of Preparation 2 is melt-blown into web at melt temperature of from about 162° C. to about 193° C. and the stretch air temperature is between about 200° C. and 275° C. The melt blown fibers are deposited on a typical porous, spun bonded, bi-component polyethylene/polypropylene substrate, having a basis weight about 15 grams per square meter: the substrate moves relative to the blown web deposition of each sample at about 3.5 meters/minute. Five sets of fibers are prepared. Extrusion pressures, as preferably measured as melt pump back pressures, range from 140 psi to 480 psi (i.e., from 0.97 megapascals (MPa) to 3.3 MPa). Melt-blowing rates are: Example 8a, 8c, and 8d: 0.007 grams/minute/spinhole or 1.62 kilograms/hour/meter; and Examples 8b: 0.0034 grams/minute/spinhole, or 0.81 kilogram/hour/meter; and Example 5e: 0.01 grams/minute/spinhole, or 2.39 kilogram/hour/meter. The die effective viscosity is between about 2.5 and 6.5. The fiber diameter distribution sizes for the fibers of Examples 8a to 8e are determined as described in Example 3 and are disclosed in FIG. 6 (respectively designated "8a" to "8e") and shown below in Table 4.

TABLE 4

| Example | Average Diameter (microns) | Median Diameter (microns) |
|---|---|---|
| 8a | 0.46 | 0.29 |
| 8b | 0.37 | 0.28 |
| 8c | 0.4 | 0.29 |
| 8d | 0.39 | 0.275 |
| 8e | 0.39 | 0.27 |

Examples 9a to 9e

Filter Media Using the MSA Diamide Diol Copolyesteramide

The procedure of Example 6 is repeated except using the fibers of Examples 8a to 8e instead of the fibers of Examples 5a to 5f and the following procedure for the basis weight measurement. For each of the fibers of Examples 8a to 8e, 4 inch×4 inch were cut from rolls of the non-woven, melt blown MSA material media to determine the basis weight: no less than 4 samples are weighed on a Mettler AE260 balance to 0.0001 gram. Samples are prepared and tested at room temperature two weeks after made to determine filter properties. Samples are deposited on 15 grams per square meter (gsm or grams/$m^2$ or g/$m^2$) basis weight of spun-bonded bi-component polyethylene/polypropylene (PE/PP) substrate to respectively give Examples 9a to 9e. The pressure drops and efficiencies are measured at 30 feet per minute media face velocity. The Frazier Permeability is calculated by measuring the pressure at 4 different media face velocities between 30 feet per minute and 140 feet per minute and using a linear fit to calculate the velocity at which the pressure drop would be 0.5 inch $H_2O$. Results are shown below in Table 5.

TABLE 5

| Example | Basis Weight (grams/m$^2$) | MERV Rating | Frazier Permeability (ft/min) | Alpha Value | Efficiency | Pressure Drop (mm of H20) |
|---|---|---|---|---|---|---|
| 9a | 8.6 | 14 | 50 | 13.9 | 90.5 | 7.4 |
| 9b | 3.3 | 14 | 51 | 15.2 | 92.2 | 7.3 |
| 9c | 7.4 | 13 | 52 | 13.3 | 89 | 7.2 |
| 9d | 6.4 | 13 | 48 | 12.2 | 89.2 | 7.9 |
| 9e | 2.5 | 13 | 61 | 15.2 | 88.7 | 6.2 |

Comparative (Non-Invention) Example 1

For comparison purposes, Hills melt-blown system as described in Example 5 prepares submicron polypropylene fibers from the MFI 1800 homo-polypropylene of Preparation 3. In such a comparison process where several runs are separately conducted, summarizing such runs, melt extrusion pressures, preferably measured as melt pump back pressures, with melts of MFI 1800 homo-polypropylene of Preparation 3 range from 1110 psi to 1270 psi (i.e., from 7.7 MPa to 8.8 MPa.; melt temperatures range from 214° C. to 248° C.; substrate moving speeds range from 3 meters/minute to 6.8 meters/minute; stretch air temperature is between about 214° C. and 274° C.; melt-blowing rates are between about 0.0045 grams/minute/spinhole or 1.07 kilograms/hour-meter and 0.006652 grams/minute/spinhole or 1.56 kilograms/hour-meter; the die effective viscosity is between about 18.5 and 26.2; and median fiber diameters, determined as described previously in Example 3, from 0.19 micron to 0.475 micron.

As shown by the Examples, the present invention provides an effective process for melt blowing a MSA material, thereby forming a fiber set having a distribution of fiber diameters wherein at least about 95% of the fibers have a diameter of less than about 3 microns. The present invention process is suitable for melt blowing even MSA materials having relatively low number average molecular weights, including Mn of less than 5,000 g/mol; relatively low melt viscosities, including less than 100 Pascal·seconds from above Tm up to about 40 degrees ° C. above Tm; or both and is capable of producing melt blown submicron fibers having median diameters below 1000 nanometers, including in some embodiments below 300 nanometers, which submicron fibers are particularly useful as a filter medium.

While the invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains and which fall within the limits of the following claims.

What is claimed is:

1. A method for fabricating fibers, the method comprising melt-blowing a melt of a molecularly self-assembling material, the melt being at a temperature of from 130 degrees Celsius to 220 degrees Celsius, thereby forming a fiber set having a distribution of fiber diameters wherein at least about 95 percent of the fibers have a diameter of less than about 3 microns, wherein the molecularly self-assembling material comprises repeat units of formula I:

Formula I

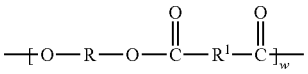

and units selected from the group consisting of esteramide units of Formula II and III:

Formula II

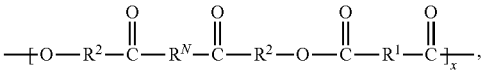

Formula III

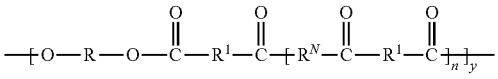

and ester-urethane units of Formula IV:

Formula IV

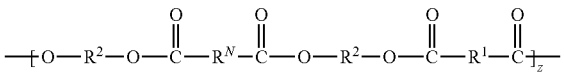

or combinations thereof wherein:

R at each occurrence is independently a $C_2$-$C_{20}$ non-aromatic hydrocarbylene group, a $C_2$-$C_{20}$ non-aromatic heterohydrocarbylene group, or a polyalkylene oxide group having a group molecular weight of from about 100 to about 5000 g/mol;

$R^1$ at each occurrence is independently a bond, or a $C_1$-$C_{20}$ non-aromatic hydrocarbylene group;

$R^2$ at each occurrence is independently a $C_1$-$C_{20}$ non-aromatic hydrocarbylene group;

$R^N$ is —N($R^3$)—Ra-N($R^3$)—, where $R^3$ is independently H or $C_1$-$C_6$ alkylene, Ra is a $C_2$-$C_{20}$ non-aromatic hydrocarbylene group, or $R^N$ is a $C_2$-$C_{20}$ heterocycloalkyl group containing the two nitrogen atoms, wherein each nitrogen atom is bonded to a carbonyl group according to Formula III;

n is at least 1 and has a mean value less than 2;

w represents the ester mole fraction of Formula I, and x, y and z represent the amide or urethane mol fractions of Formulas II, III, and IV; where w+x+y+z=1, and 0<w<1, and at least one of x, y and z is greater than zero but less than 1.

2. The method according to claim 1, the melt being at a temperature of from 150 degrees Celsius to 220 degrees Celsius.

3. The method according to claim 1 wherein, the molecularly self-assembling material has a number average molecular weight of from 2000 grams per mole to 50,000 grams per mole.

4. The method according to claim 1 wherein the molecularly self-assembling material comprises self-assembling repeat units.

5. The method according to claim 1, wherein viscosity of the molecularly self-assembling material is less than 100 Pascal-seconds from above Tm up to about 40 degrees Celsius above Tm.

6. The method according to claim 1 wherein melt-blowing is at a rate of about 0.5 kilogram per hour per meter to about 75 kilograms per hour per meter.

7. The method according to claim 1 wherein the melt-blowing stretch air temperature is from 100 degrees Celsius to 300 degrees Celsius.

8. The method of claim 1, further comprising collecting the fiber set so as to form a fibrous web.

9. The method according to claim 1, the method employing a melt blowing die having a plurality of channels, each channel independently being characterizable as having a die expected viscosity of from 0.1 Pascal-second to less than 12 Pascal-seconds.

10. An article comprising or prepared from the melt-blown fibers formed by the method of claim 1.

11. The article of claim 10, wherein the article comprises a mechanical particulate filter media, the mechanical particulate filter media comprising the melt-blown fibers, the melt-blown fibers having a non-woven basis weight of from about 0.08 gram per square meter to about 300 grams per square meter, and a fiber diameter distribution wherein about 95 percent of the melt-blown fibers have diameter of less than about 3.0 microns, such melt-blown fibers being media fine fibers.

12. The article of claim 11 wherein the media fine fibers have an average diameter less than about 1.0 micron.

13. The article of claim 11 wherein the mechanical particulate filter media has a Frazier Permeability of from about 34 feet per minute to about 760 feet per minute.

14. The article of claim 11 wherein the mechanical particulate filter media has a MERV rating of any integer of from 5 to 14, inclusive.

15. The article of claim 11 wherein the mechanical particulate filter media has an alpha-value of from about 1.8 to about 23.2.

16. The article according to claim 11 wherein the mechanical particulate filter media exhibits an elongation of from about 50 percent to about 90 percent, and a tensile strength of from about 2 Newtons per 5 centimeters to about 10 Newtons per 5 centimeters.

17. The article comprising the mechanical particulate filter media according to claim 11, the article comprising a web of the media fine fibers, a supporting structure wherein the media fine fibers are deposited thereon, wherein the supporting structure is a relatively rigid material for holding the web of media fine fibers, and is a polymer, metal, fiberglass, ceramic, cellulosic, or a combination thereof, and wherein the support structure does not substantially retard airflow through the mechanical particulate filter media.

18. The article of claim 17, the supporting structure comprising a web of supporting fibers having a basis weight of from 5 grams per square meter to 300 grams per square meter.

19. The method of claim 1, wherein about 65 percent of the fibers are less than about 1.0 micron in diameter.

20. The method of claim 1, wherein the molecularly self-assembling material has a tensile modulus of from about 4 megapascals to about 500 megapascals at 20° C.

* * * * *